United States Patent [19]

Larsson

[11] Patent Number: 5,069,616

[45] Date of Patent: Dec. 3, 1991

[54] IGNITION DEVICE FOR LANCES

[75] Inventor: Arne Larsson, Stockholm, Sweden

[73] Assignee: Oxy-Tuben AB, Hofors, Sweden

[21] Appl. No.: 488,018

[22] PCT Filed: Nov. 10, 1988

[86] PCT No.: PCT/SE88/00603

§ 371 Date: May 8, 1990

§ 102(e) Date: May 8, 1990

[87] PCT Pub. No.: WO89/04417

PCT Pub. Date: May 18, 1989

[30] Foreign Application Priority Data

Nov. 12, 1987 [SE] Sweden ..... 8704421

[51] Int. Cl.[5] ..... F23Q 1/00

[52] U.S. Cl. ..... 431/267; 431/269; 431/48; 266/225; 102/205

[58] Field of Search ..... 431/267, 268, 269, 99; 110/349; 266/48, 225; 102/205

[56] References Cited

U.S. PATENT DOCUMENTS

| | | | |
|---|---|---|---|
| 2,634,196 | 4/1953 | Pennecot | 431/267 |
| 3,507,230 | 4/1970 | Seib | 110/1 |
| 4,915,618 | 4/1990 | Brandin | 431/269 |

FOREIGN PATENT DOCUMENTS

| | | |
|---|---|---|
| 0007289 | 1/1980 | European Pat. Off. . |
| 0100702 | 2/1984 | European Pat. Off. . |
| 415590 | 10/1980 | Sweden . |
| 668393 | 3/1952 | United Kingdom . |

*Primary Examiner*—James C. Yeung

[57] ABSTRACT

An ignition device for lances, such as lances intended for supplying oxygen gas to metallurgical processes, having a tubular casing intended to be fitted partially onto one end of a lance and the end part of which, located distal from the lance, carries a striker, which includes a pyrotechnical delay, extending into the tubular casing, and a reaction mass which is arranged in the casing and which can be ignited by the striker. The ignition device includes an end stop located in the casing adjacent the reaction mass, the end of the lance being intended to be brought into engagement with the end stop when fitting the device on the lance.

13 Claims, 1 Drawing Sheet

IGNITION DEVICE FOR LANCES

Figure 1:
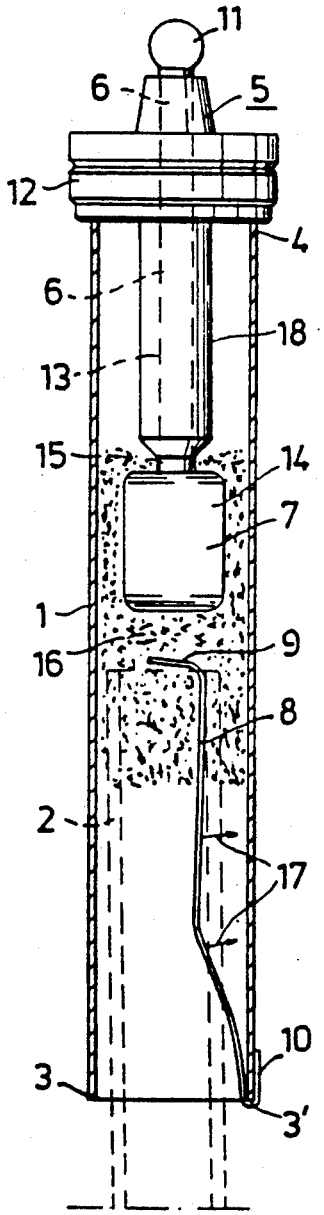

The present invention relates to a lance ignition device, used with lances of the kind which are intended for supplying gaseous oxygen to metallurgical processes, the device including a tubular casing which is intended to be fitted to one end of a lance and which carries a striker equipped with a pyrotechnical delay which extends into the casing, and further including a reaction mass located in the casing and intended for ignition by the striker.

Ignition devices essentially of this kind are known to the art. One serious problem with these known devices resides in the prevention of mechanical activation of the reaction mass and of the striker by the lance, and also in ensuring that the reaction mass and the striker will not be dislodged from the casing when fitting the device to the lance. The known devices are also vulnerable in other respects. For instance, the striker or corresponding device is liable to fractural damage or some corresponding damage, resulting in the formation of discontinuities and therewith causing an initiated ignition process to abort. Unless properly controlled, the reinstatement of an aborted ignition sequence can result in uncontrolled ignition of the oxygen gas and therewith constitute a serious safety risk. These problems are, of course, particularly accentuated in such industrial environments as those in which the working tempo is particularly high and the handling of this kind of material is, perhaps, clumsily carried out.

The present invention relates to an ignition device which substantially eliminates the above mentioned problems and which, in other respects, is constructed in a particularly suitable manner.

The present invention thus relates to an ignition device which is intended for lances, such as those intended for supplying oxygen gas to metallurgical processes, and which device comprises a hollow tubular casing which is intended to be fitted partially onto one end of the lance and the end part of which device, remote from the lance, carries a striker having a pyrotechnical delay which extends into the casing, and which further comprises a reaction mass which is located in the tubular casing and is capable of being ignited by the striker.

The inventive ignition device is particularly characterised by an end stop which is mounted in the tubular casing at a location adjacent the reaction mass and against which one end of the lance is intended to be brought.

The invention will now be described in more detail with reference to an exemplifying embodiment thereof illustrated in the accompanying drawing, in which:

FIG. 1 illustrates schematically a first embodiment of an inventive device, where half of the tubular casing has been removed and the device is seen perpendicularly to the direction of its axis.

In FIG. 1, the reference 1 identifies a substantially tubular and cylindrical casing, which is preferably made of steel. The casing is intended to be fitted partially onto a lance end portion 2, shown in broken lines, the casing having an open end 3 for this purpose. The casing end 4, which is intended to be distal from the lance 2, carries a striker 5 for ignition of a reaction mass 7 located in the casing, through a pyrotechnical delay 6 extending into the casing.

The reference 8 identifies a substantially band-like metal strip which extends from the open end 3 of the casing through which the lance end is inserted and terminates essentially adjacent but not engaging the reaction mass, at which location a part 9 of the strip or band extends substantially at right angles to the long axis of the casing such as to form an end stop 9.

In the case of the illustrated embodiment, the strip 8 is attached to the open end 3 of the casing by means of a bent back, substantially U-shaped end clip 10, which embraces an edge part 3' of the casing open end 3.

In the case of its preferred embodiment, the metal strip 8 extends from a bent back clip part 10, clipped to the edge 3' of casing end 3, and extends through a small angle bend inwardly towards the centre axis of said casing and then extends substantially along the casing axis, to a location intermediate the length of the casing, as illustrated, where the strip is bent substantially transversally to said axis to form the end stop 9.

The striker 5 comprises as a unit an ignition charge 11 and the aforesaid delay 6 and is fastened to the casing with the aid of an end wall piece 12, from which the ignition charge 11 protrudes and through which the delay 6 passes into the casing. Preferably, the pyrotechnical delay extends through a metal tube 13, aluminum being preferred, as shown in broken lines in FIG. 1, tube, to provide mechanical protection for the delay.

In the case of the illustrated embodiment, the reaction mass 7 is comprised essentially of metal powder, preferably aluminium powder, and is contained in a container, such as a thin plastic bag 14, which is located adjacent the end 15 of the delay in the casing. The container will preferably be located contiguous with the end 15 of the delay without being attached thereto, the casing having provided therein a protecting and fixating filling material 16, such as cotton 16.

The modus operandi of the inventive ignition device will be understood in all essentials from the above description of said device. Thus one end 2 of a lance is inserted into the casing end 3, wherewith the metal strip 8 will be sprung to one side to some extent against an inherent spring force, as indicated by the arrows 17, and the spring force of the flexed strip 8 will hold the ignition device securely subsequent to fitting the device to the lance. The lance cannot be inserted into the casing further than the end stop 9 and cannot therefore be made to push out the striker etc. Because of the spacing of the strip 8 away from the interior wall surface of the casing 1 and the springiness of the metal strip, the same ignition device can be used in connection with many lances having different diameters. In this respect, the inner diameter or like transverse dimension of the casing is such that the casing is able to accommodate a relatively wide range of conventionally occurring lance diameters. The ignition charge is ignited against the striker, whereupon the delay burns into the reaction mass and is able to ignite the protective material and the reaction mass, and in appropriate cases, also the tube through which the delay extends. Combustion takes place while consuming oxygen, and oxygen gas can hence be supplied through the lance.

The end 2 of the lance is subsequently ignited, primarily by the reaction mass, and the lance can be kept burning.

By using a striker of the aforedescribed kind, fitting is facilitated, the delay is protected and the device is able to withstand rough handling.

The reaction mass arrangement also facilitates fitting of the device and contributes to the impact durability thereof.

As will be understood from the aforegoing, the inventive arrangement provides a well adapted ignition device which is extremely safe in operation.

The invention has been described in the aforegoing with reference to an exemplifying embodiment thereof. It will be understood, however, that other embodiments and minor modifications are conceivable without departing from the scope of the inventive concept.

Preferably, the striker is made of a plastics material, the delay and tube extends through a plastics jacket 18 and the ignition charge is located outside said jacket.

The tubular casing is, of course, not restricted to a circular cross-sectional shape, but may be given some other shape in cross-section.

The metal strip 8 instead of having the form of a band, may have the form of a wire or some other form.

The strip 8 may also be attached to the casing in some other manner than through the U-shaped clip part 10, e.g. as by welding or adhesive bonding.

I claim:

1. An ignition device for use with lances for supplying oxygen gas to metallurgical processes, said device comprising: a tubular casing having an open end to be fitted over and partially onto one end of a lance, the other end of said casing which will face away from the lance includes a striker, a pyrotechnical delay which extends into the casing, and a reaction mass located in the casing adjacent to and ignitable by said pyrotechnical delay which is ignited by said striker, and further including an end stop 9 fixed to the casing (1) inside of and at a location intermediate its ends and adjacent said reaction mass (7); said end stop (9) being fixed to said casing against movement toward said other end thereby providing a stop against which the one end (2) of the lance, over which the casing is fitted, will abut.

2. A device according to claim 1, wherein said striker (5) includes as a unit an ignition charge (11) and said delay (6), and wherein an end wall at said other end of said casing secures the striker (5) to the casing, so that said ignition charge (11) protrudes from the exterior of said end wall and said pyrotechnical delay extends into the casing.

3. A device as defined in claim 2, wherein a metallic tube extends from said end wall into said casing and said pyrotechnical delay projects through said metallic tube.

4. A device as defined in claim 3, wherein said metallic tube is made from aluminum.

5. A device according to claim 1, wherein a thin plastic container is provided in said casing and the reaction mass (7) is contained in said thin plastics container (14), and is located adjacent the end (15) of the delay (6) within the casing.

6. A device according to claim 5, wherein the container (14) is placed contiguous with the end of said delay within said casing (15) without being attached thereto, and wherein protective and fixating filling material (16) is arranged around said reaction mass in the casing.

7. A device as defined in claim 6, wherein said protective and fixating filling material is cotton wool.

8. A device as defined in claim 5, wherein said reaction mass is metal powder.

9. A device as defined in claim 5, wherein said container is a plastic bag.

10. An ignition device for use with lances use for supplying oxygen gas to metallurgical processes, said device comprising: a tubular casing having an open end to be fitted over and partially onto one end of a lance, the other end of said casing which will face away from the lance includes a striker, a pyrotechnical delay which extends into the casing, and a reaction mass located in the casing adjacent to and ignitable by said pyrotechnical delay which is ignited by said striker; means comprising an end stop fixed to the casing and located inside of and intermediate the ends of said casing adjacent said reaction mass; said end stop being fixed to said casing against movement toward said other end to thereby provide a stop against which the one end of the lance, over which the casing is fitted, will abut; said means which comprises an end stop including a substantially strip-like metal element (8) which has a given springiness and which extends from the open end (3) of the casing internally of and longitudinally of the casing and terminates in a terminal end part essentially adjacent the reaction mass (7), and disposed transversally to the direction of the axis of the casing (1); said terminal end part of said strip-like element being said end stop.

11. A device according to claim 10, wherein the other end of the strip-like element (8) is attached to the peripheral edge of the open end (3) of the casing (1); and said other end of the strip-like element is shaped to a substantially U-shaped clip part (10) which clips over an edge part (3') of the casing at said open end.

12. A device according to claim 10, wherein the other end of the strip-like element is located and fixed at the edge of the open casing end (3) and said strip-like element extends toward the other end of said casing and inclines inwardly towards the centre axis of the casing, then extending substantially along said axis and then to its terminal end part which extends substantially transversally to said axis to form said end stop (9).

13. An ignition device for use with lances use for supplying oxygen gas to metallurgical processes, said device comprising: a tubular casing having an open end to be fitted over and partially onto one end of a lance, the other end of said casing which will face away from the lance includes a striker, a pyrotechnical delay which extends into the casing, and a reaction mass located in the casing adjacent to and ignitable by said pyrotechnical delay which is ignited by said striker; means comprising an end stop fixed to the casing and located inside of and intermediate the ends of said casing adjacent said reaction mass; said end stop being fixed to said casing against movement toward said other end to thereby provide a stop against which the one end of the lance, over which the casing is fitted, will abut; said means which comprises an end stop including a substantially strip-like metal element (8) which has a given springiness and which extends from the open end (3) of the casing internally of and longitudinally of the casing and terminates in a terminal end part essentially adjacent the reaction mass (7), and disposed transversally to the direction of the axis of the casing (1); the cross-sectional internal shape of the casing being of a size to accommodate a substantial number of sized of lances with different cross-sectional external shapes essentially complementary to said casing internal shape; and said springiness of said strip-like element enabling a friction fit adaptation of the device over the different sizes of lances.

* * * * *

UNITED STATES PATENT AND TRADEMARK OFFICE

CERTIFICATE OF CORRECTION

PATENT NO. : 5,069,616

DATED : December 3, 1991

INVENTOR(S) : ARNE LARSSON

It is certified that error appears in the above-identified patent and that said Letters Patent is hereby corrected as shown below:

IN THE CLAIMS:

Claim 10, column 3, line 65, change "use" (second occurrence) to read --used--.

Claim 13, column 4 line 37, change "use" (second occurrence) to read --used--.

Signed and Sealed this

Ninth Day of March, 1993

*Attest:*

*Attesting Officer*

STEPHEN G. KUNIN

*Acting Commissioner of Patents and Trademarks*